US006616269B2

(12) United States Patent
Nozawa

(10) Patent No.: US 6,616,269 B2
(45) Date of Patent: Sep. 9, 2003

(54) SUBSTRATE FOR INK JET PRINT HEAD, INK JET PRINT HEAD AND MANUFACTURING METHODS THEREFOR

(75) Inventor: Minoru Nozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/897,958

(22) Filed: Jul. 5, 2001

(65) Prior Publication Data

US 2002/0018102 A1 Feb. 14, 2002

(30) Foreign Application Priority Data

Jul. 10, 2000 (JP) ..... 2000-209101

(51) Int. Cl.[7] ..... B41J 2/05
(52) U.S. Cl. ..... 347/58
(58) Field of Search ..... 347/50, 58, 59, 347/63

(56) References Cited

U.S. PATENT DOCUMENTS 4,695,853 A * 9/1987 Hackleman et al. ..... 347/62
4,916,464 A * 4/1990 Ito et al. ..... 347/237
5,227,812 A * 7/1993 Watanabe et al. ..... 347/50

* cited by examiner

*Primary Examiner*—Judy Nguyen
*Assistant Examiner*—Michael S Brooke
(74) *Attorney, Agent, or Firm*—Fitzpatrick, Cella, Harper & Scinto

(57) ABSTRACT

In the electrode pads in the ink jet print head substrate that uses ball bumps, bonding of the ball bumps is carried out in satisfactory condition despite reduced thickness of films in the substrate. In an ink jet print head substrate, which has a heater film constituting the heater portions, a second electric wire in electrical contact with the heater film to supply it with electric power, and a first electric wire constituting a common electrode of a matrix wire for selectively driving the heater portions, the first electric wire is used as the electrode pads to which the ball bump is joined. The first electric wire does not need to be reduced in thickness even when the thickness of the protective film is reduced. Thus, an ultrasonic wave can be transferred well to the electrode pad during ultrasonic bonding.

6 Claims, 20 Drawing Sheets

PRIOR ART

PRIOR ART

PRIOR ART

SUBSTRATE FOR INK JET PRINT HEAD, INK JET PRINT HEAD AND MANUFACTURING METHODS THEREFOR

This application is based on Patent Application No. 2000-209101 filed Jul. 10, 2000 in Japan, the content of which is incorporated hereinto by reference.

BACKGROUND OF THE INVENTION

1. Field of the Invention

The present invention relates to a substrate for an ink jet print head, an ink jet print head and a manufacture method thereof, and more particularly to a structure of a bump electrode pad used for electrical connection between the substrate and electric wiring such as a TAB tape, both forming the ink jet print head.

2. Description of the Prior Art

The manufacture of an ink jet print head involves a process of connecting two components: a head chip (hereinafter simply referred to as a "chip" or "print element substrate"), which is composed of a substrate has formed therein heaters and a driver IC and matrix wires for driving the heaters and a nozzle forming member in which ink ejection ports are formed, and a TAB tape electrically connects the print head to a printer body. This connecting process is normally performed by using both heat and ultrasonic wave to connect the bumps provided on the electrode pad on the chip to inner leads of the TAB tape.

A commonly used bump is a so-called plated bump which is formed by forming and patterning a $SiO_2$ or SiN film as a passivation layer, forming one to three layers of barrier metal such as Ti, Cu and W as a contact improving layer on aluminum electrodes, forming a resist pattern over the barrier metal layer by photolithography, and finally growing gold by electrolytic plating.

The forming of the plated bump requires performing several cycles of a vacuum film forming process and an exposure/development process. Because in the case of the plated bump an entire wafer is subjected to the plating process, not only sound chips but also chips that become faulty in the subsequent steps are formed with gold-plated bumps. This leads to a possible increase in cost. Further, when the number of electrode pads per the wafer is small (i.e., when the number of bumps is small), the cost per bump increases.

For these reasons, an increasing number of a ball bumps are being used in recent years. The ball bump is formed by using the wire bonding method. In this forming process an arc discharge is applied to the front end of a wire passed through a ceramic tube called capillary to form a ball, which is then joined to a predetermined electrode pad on the substrate by using both heat and ultrasonic wave. Then, the capillary is lifted while at the same time the wire is held by a cut clamper, thus fracturing the wire by a tensile strength to cut off the ball portion and thereby form a bump. Another method of joining the balls to the electrode pad is known to use only heat, rather than using both heat and ultrasonic wave as in the above method.

As described above, the ball bump does not require the expensive vacuum film forming device and exposure device as do the plated bump. Further, because the passivation film and the barrier metal are not necessary, the ball bump is more advantageous than the plated bump in terms of cost when the number of pads per a piece of wafer is small.

In an ink jet print head that uses thermal energy produced by a heater to eject ink, films making up the heater or the like tend to decrease in thickness. The structure of this type of print head will be discussed as follows in terms of the thickness of the film tending to decrease.

An example substrate making such an ink jet print head is made by successively forming on a silicon base an IC film (made up of about six layers) for a driver IC or the like which consists of semiconductor devices to drive the heater in ejecting ink, a first interlayer insulating film (e.g., SiN film) forming a lowermost layer in contact with the base, a first electric wiring film (e.g., Al film) forming a common electrode for supplying an electric power to drive the heater by the driver IC in response to a drive signal or a common electrode for grounding, a second interlayer insulating film (e.g., SiO film) overlying the first electric wiring film, a heater film (e.g., TaN film) forming the heater, a second electric wiring film (e.g., Al film) directly connected to the heater to supply an electric power to the heater, and a wear resistant film (e.g., Ta film) overlying the second electric wiring film.

FIG. 16 is a plan view showing a conventional example of a heater and an electric wire for driving the heater corresponding to one ejection port in the substrate for the ink jet print head of the type described above. FIG. 17 is a perspective view showing a head chip made by forming, on the substrate having the electric wiring film or the like, a nozzle forming member in which ink ejection ports or the like are formed.

In order to selectively drive a plurality of heaters to eject ink according to print data, the substrate for the print head is normally formed with a matrix electrode wire. In FIG. 16 a first electric wire 202 represents a common electrode forming a part of the matrix wire and is connected in a through-hole portion 105 to a second electric wire 205 which in turn is connected to a heater film 204 forming a heater 101. More specifically, as described later by referring to FIG. 18, the first electric wire 202 is formed as lower layer with respect to a direction of thickness of the substrate, and this wire 202 and the second electric wire 205 formed as an upper layer than the wire 202 are generally formed in separate steps in a substrate making process and thus are electrically interconnected via the through-holes. Further, as to the connections for supplying an electric power and a drive signal to the head chip and connections for grounding the substrate potential, the substrate is formed at its end portions with electrode pads 110, as shown in FIG. 17, for electrical connection to a printer body.

FIG. 18 is a cross section showing a film structure of mainly the heater portion 101, the through-hole portion 105 and the electrode pad portions 110 in the above substrate structure.

The film structure of the heater 101 and its vicinity is presented in FIG. 18 as a cross section taken along the line 18*a*—18*a* of FIG. 16. On the silicon base 11 are laminated a first interlayer insulating film 201, a second interlayer insulating film 203, a heater film 204, a part of the second electric wire film 205, a protective film 206, and a wear resistant film 207.

In FIG. 18 the film structure of the through-hole portion 105 that connects the first electric wire film 202 and the second electric wire film 205 is presented as a cross section taken along the line 18*b*—18*b* of FIG. 16. On the silicon base 11 are successively laminated the first interlayer insulating film 201, the first electric wire film 202, the second interlayer insulating film 203, the heater film 204, the second electric wire film 205, the protective film 206 and the wear resistant film 207. In this film structure, the second interlayer insulating film 203 is partly formed with through-holes to electrically connect the first electric wire film 202 to the second electric wire film 205 through the heater film 204.

Further, in FIG. 18 the film structure of the electrode pad is presented as a cross section taken along the line 18*c*—18*c* of FIG. 17. The first interlayer insulating film 201, the first electric wire film 202, the heater film 204, and the second electric wire film 205 are successively laminated.

As described above, although the first electric wire film 202 and the second electric wire film 205 are electrically connected together, they are formed as separate films owing to different functions performed. That is, they are formed in separate manufacture processing steps. In more concrete terms, the first electric wire film 202 is formed under the heater film 204. On the other hand, the second electric wire film 205 is formed over the heater film. For the sake of the film making process, the heater film 204 and the second electric wire film 205 are also formed in the electrode pad portion 110 along with the heater portion 101 and the through-hole portion 105. The second electric wire film 205 in the electrode pad portion 110 forms a surface conductive film in contact with the ball bumps.

In the bubble jet type print head composed of the substrate with the above-described structure, the density of ink ejection ports and their associated structures in the print head are being increasingly enhanced in recent years to cope with the growing demands for faster printing and higher print quality. Such an increase in density may cause a problem of a heat generation or heat storage. For example, the heat generated by the heater in ejecting ink is mostly released outside together with the ejected ink droplet, with the remaining heat, which is small, accumulated in the head when the printing process continues. When the ink ejection ports are arranged in high density, the extent to which the heat is accumulated increases, causing the head temperature to rise, resulting in an ejection failure or a broken head.

To deal with this problem, it is important to minimize the amount of energy applied to the print head for ink ejection. In this respect, measures to improve the thermal efficiency of ink ejection include, for example, reducing the thickness of the protective film over the heater film to transfer heat to the ink with an increased efficiency. For example, reducing the thickness of the protective film from the conventional 8000 Å to 3000 Å can reduce the energy applied to the print head at time of ink ejection by about 40%.

Such a reduction in the thickness of the protective film, however, degrades a coverage by the protective film of stepped portions of the electric wires. To deal with this situation, the second electric wire film 205 such shown in FIG. 18, which is covered by the protective film and formed over the heater film, is reduced in thickness to minimize a vertical difference between levels at the stepped portion and thereby prevent the deterioration of step coverage. For example, the aluminum film of the electric wire is reduced in thickness from the conventional 4,000 Å to 2,000 Å.

However, the above-described reducing the thickness of the second electric wire causes reducing the thickness of the second electric wire film in the electrode pad portion, i.e., the surface conductive film in contact with the ball bumps. As a result, the ball bumps may result in a faulty joint and, in the worst case, may cause a bump loss, the phenomenon in which bumps come off the electrode pad. For example, when gold is used as a material of the ball bump and an aluminum electric wiring layer is used as a surface conductive film that comes into contact with the bumps on the electrode pad, the frequency of the bump loss generally increases as the thickness of the aluminum electric wiring layer decreases.

As described above, a trouble may occur in which the surface conductive film fails to adhere to the ball bumps or their joining strength is weak (generally evaluated by the strength measured by a shear tester). This is explained as follows. Because the second electric wire film of, for example, aluminum formed over the relatively hard heater film is thin, resulting in a reduced joining strength of an alloy of gold ball bump and aluminum joined by ultrasonic bonding. Increasing the intensity of the ultrasonic wave for solving this problem, however, may cause cracks in the pad portion in the substrate. Further, to minimize the energy necessary for ink ejection requires a further reduction in the thickness of the protective film and its associated second electric wire film, for example, down to 1,500 Å and 1,000 Å, respectively. This in turn makes the problem of poor junction of ball bumps more significant.

SUMMARY OF THE INVENTION

An object of the present invention is to provide a substrate for an ink jet print head, an ink jet print head and a method of manufacture thereof, which assures a satisfactory joint between a ball bump and an electrode pad regardless of a reduction in the film thickness in the substrate for the ink jet print head.

In a first aspect of the present invention, there is provided a substrate for an ink jet print head that uses thermal energy to eject ink, the substrate comprising:

a film structure having a plurality of films laminated over the substrate, the plurality of films including a first electric wire film, a heater film and a second electric wire film formed one upon the other in that order over the substrate, a combination of the heater film and the second electric wire film allowing the thermal energy to be generated;

wherein an electrode pad portion, which is formed at a part of the film structure to make electrical connection to other than the substrate through a ball bump, is formed by an exposed part of the first electric wire film, and a thickness of the first electric wire film is larger than that of the second electric wire film.

In a second aspect of the present invention, there is provided an ink jet print head which uses thermal energy to eject ink, comprising:

a substrate making the ink jet print head, the substrate including:

a film structure having a plurality of films laminated over the substrate, the plurality of films including a first electric wire film, a heater film and a second electric wire film formed one upon the other in that order over the substrate, a combination of the heater film and the second electric wire film allowing the thermal energy to be generated;

wherein an electrode pad portion, which is formed at a part of the film structure to make electrical connection to other than the substrate through a ball bump, is formed by an exposed part of the first electric wire film, and a thickness of the first electric wire film is larger than that of the second electric wire film.

In a third aspect of the present invention, there is provided a method of manufacturing an ink jet print head which uses thermal energy to eject ink, the method comprising the steps of:

forming a substrate, the substrate constituting the ink jet print head and having a film structure, the film structure having at least a first electric wire film, an interlayer insulating film, a heater film, a second electric wire film and a protective film laminated one upon the other in that order over the substrate, a combination of the heater film and the second electric wire film allowing the thermal energy to be generated;

wherein, in an electrode pad portion formed by a part of the step of forming the film structure of the substrate and adapted to make electrical connection to other than the substrate through a ball bump, the interlayer insulating film is removed to expose the first electric wire film and to make an exposed part of the surface first electric wire film be a part to which the ball bump are joined.

In a fourth aspect of the present invention, there is provided a method of manufacturing an ink jet print head which uses thermal energy to eject ink, the method comprising the steps of:

forming a substrate, the substrate constituting the ink jet print head and having a film structure, the film structure having at least a first electric wire film, an interlayer insulating film, a heater film, a second electric wire film and a protective film laminated one upon the other in that order over the substrate, a combination of the heater film and the second electric wire film allowing the thermal energy to be generated;

wherein, in an electrode pad portion formed by a part of the step of forming the film structure of the substrate and adapted to make electrical connection to other than the substrate through a ball bump, after the interlayer insulating film is patterned to form a window therein, the heater film and the second electric wire film are deposited one upon the other and then removed to expose the first electric wire film and to make an exposed part of the surface first electric wire film be a part to which the ball bump are joined.

With the above construction, because the exposed part of the first wire electrode underlying the heater forms the electrode pad, a film which does not need to be reduced in thickness to secure the heater protective film's step coverage even when the protective film is made thinner can be used for the electrode pad. Further, an inherently thick film can be used for the electrode pad. As a result, when the ball bump is joined by an ultrasonic bonding process bonding, the bonding strength can be increased.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Embodiments of the present invention will be described below in detail with reference to the drawings.

A general structure of an ink jet printer which uses a ink jet print head will be explained below by referring to FIGS. 1–10, before explaining a structure of an electrode pad in the ink jet print head according to one embodiment of the present invention.

A term "printing", as used herein, refers to formation of images, patterns, or the like on a printing medium or processing of the printing medium whether meaningful information such as characters, graphics, or the like or meaningless information is to be formed or whether or not the information is embodied so as to be visually perceived by human beings.

A term "printing medium", as used herein, refers not only to paper for use in general printing apparatuses but also to materials such as cloths, plastic films, metal plates, glass, ceramics, woods, and leathers which can receive inks.

Furthermore, a term "ink" (or "liquid") should be broadly interpreted as in a definition of the above term "printing", and refers to a liquid that is applied to the printing medium to form images, patterns, or the like, process the printing medium, or process the ink (for example, solidify or insolubilize a coloring material in the ink applied to the printing medium).

1. Apparatus Body

Figure 1:
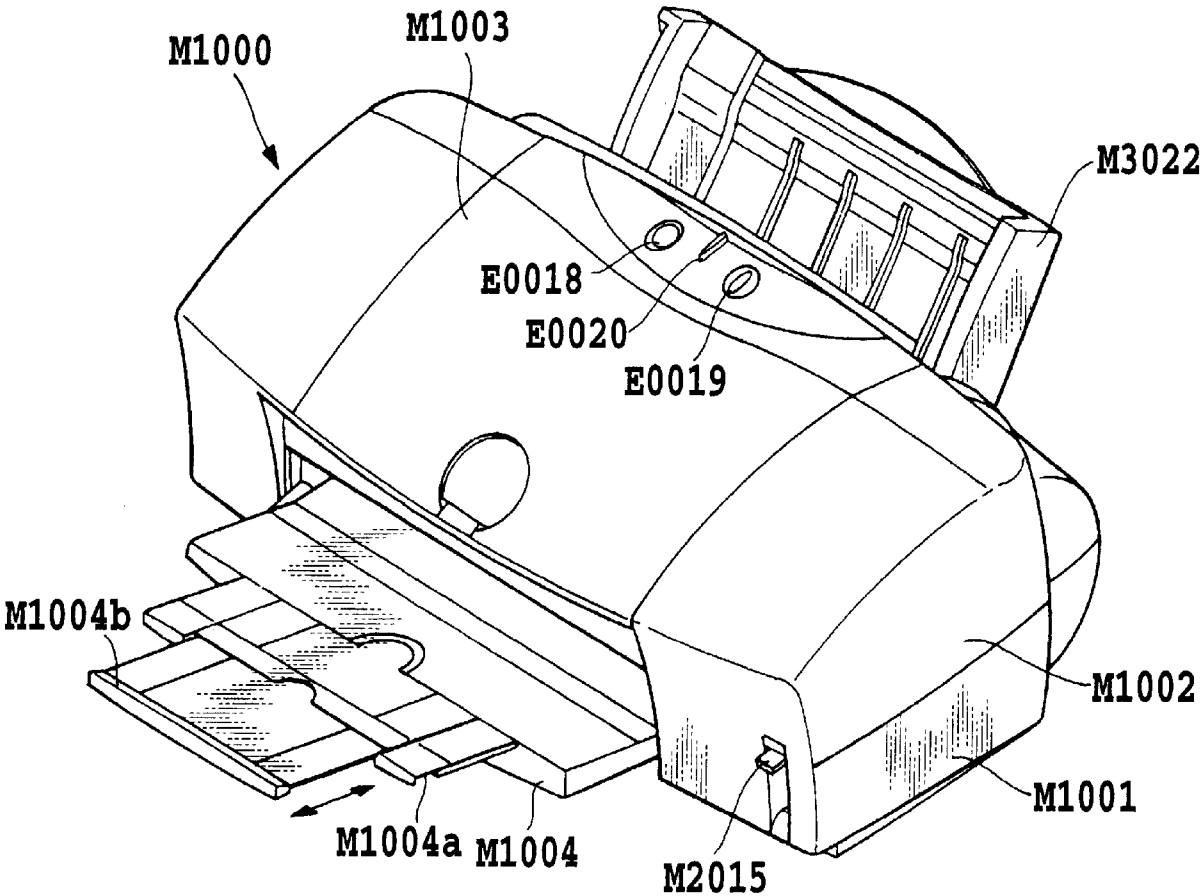
FIG. 1 is a perspective view showing an external construction of an ink jet printer as one embodiment of the present invention.
Figure 2:
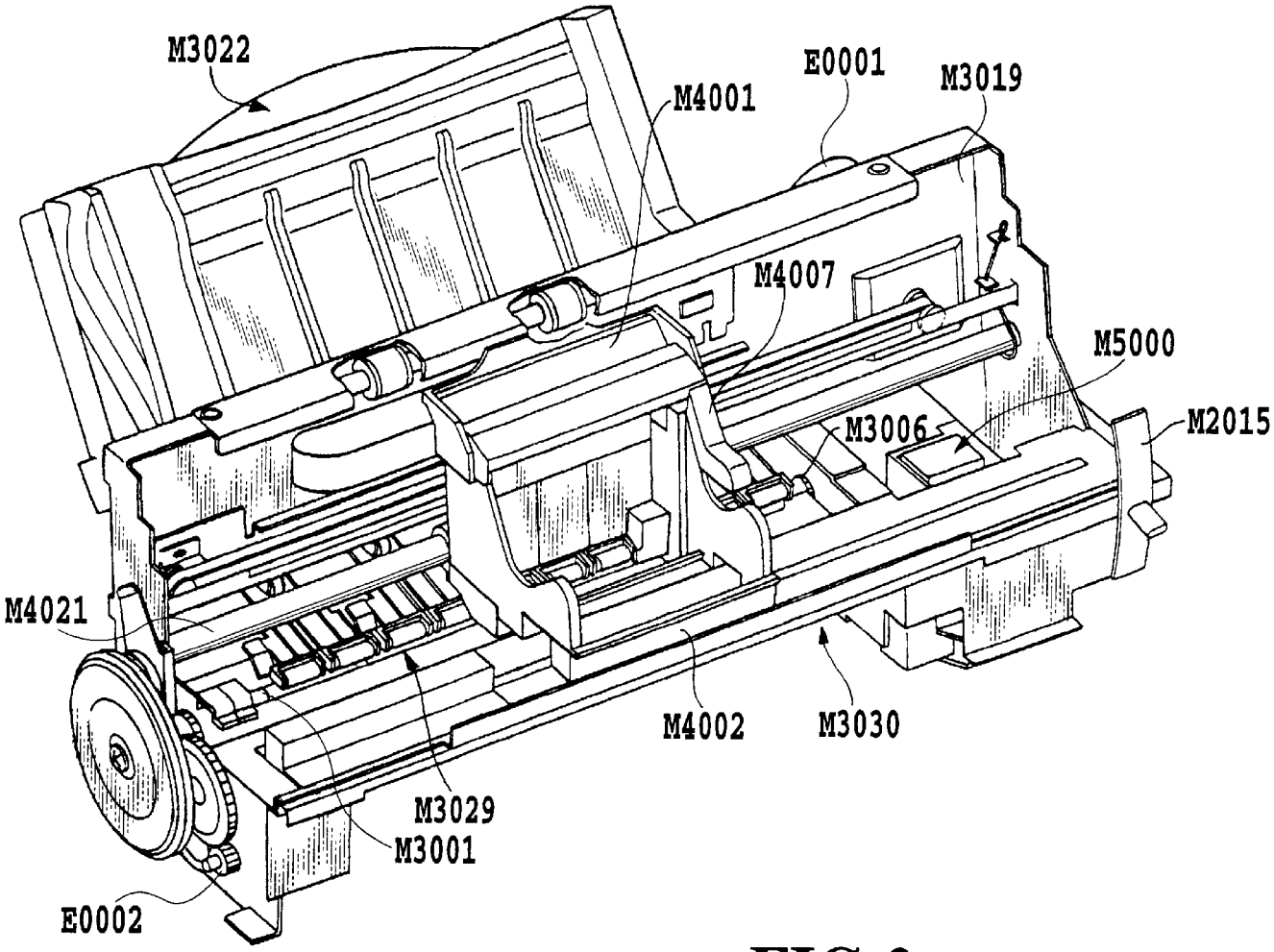
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 7) may be sounded. When the trouble is eliminated, the resume key E0019 is pressed to resume the printing.

2. Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

Here, the print unit will be described. The print unit comprises a carriage M4001 movably supported on a carriage shaft M4021 and a print head cartridge H1000 removably mounted on the carriage M4001.

2.1. Print Head Cartridge

First, the print head cartridge used in the print unit will be described with reference to FIGS. 3 to 5.

Figure 3:
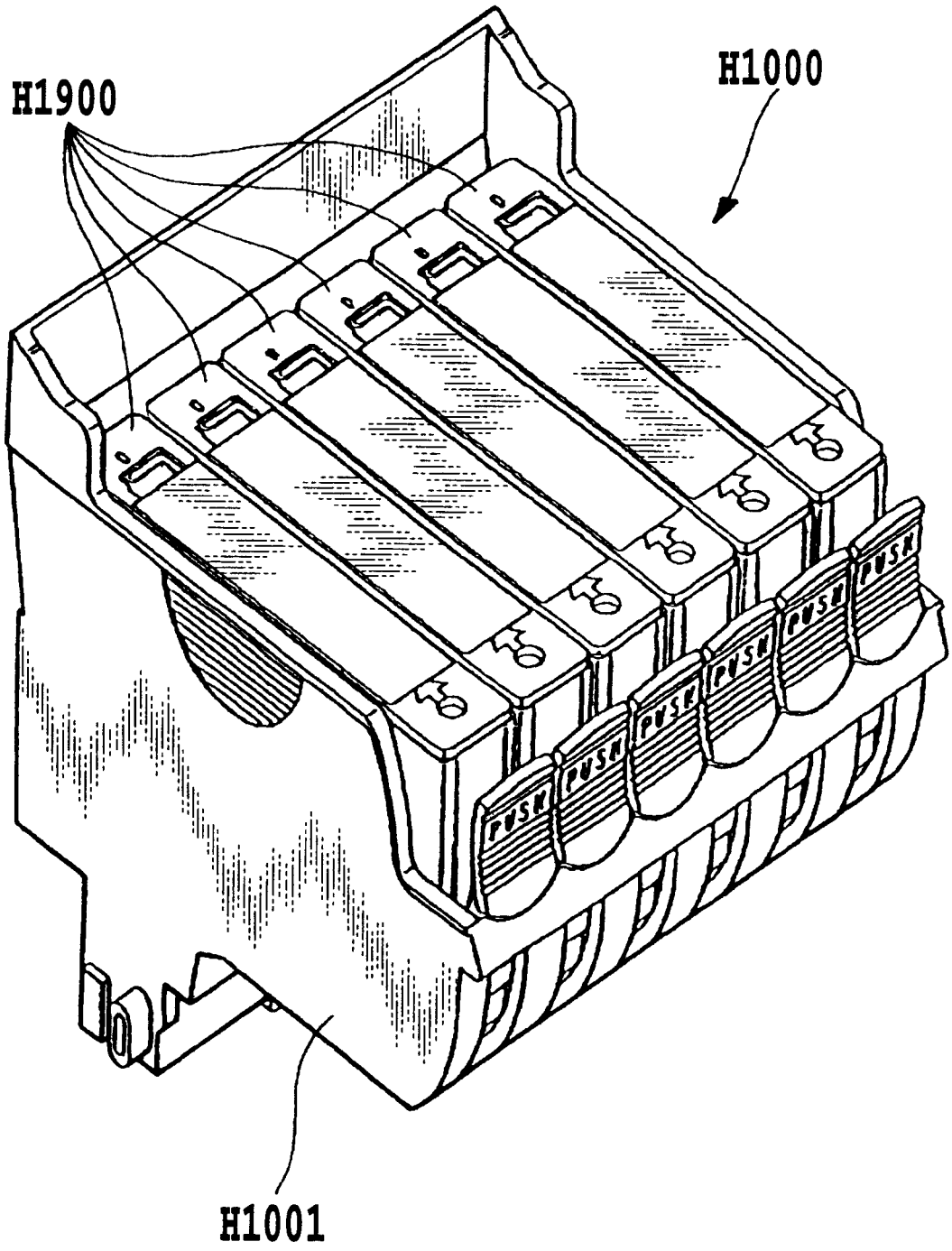
FIG. 3 is a perspective view showing an assembled print head cartridge used in the printer of one embodiment of the present invention.
Figure 4:
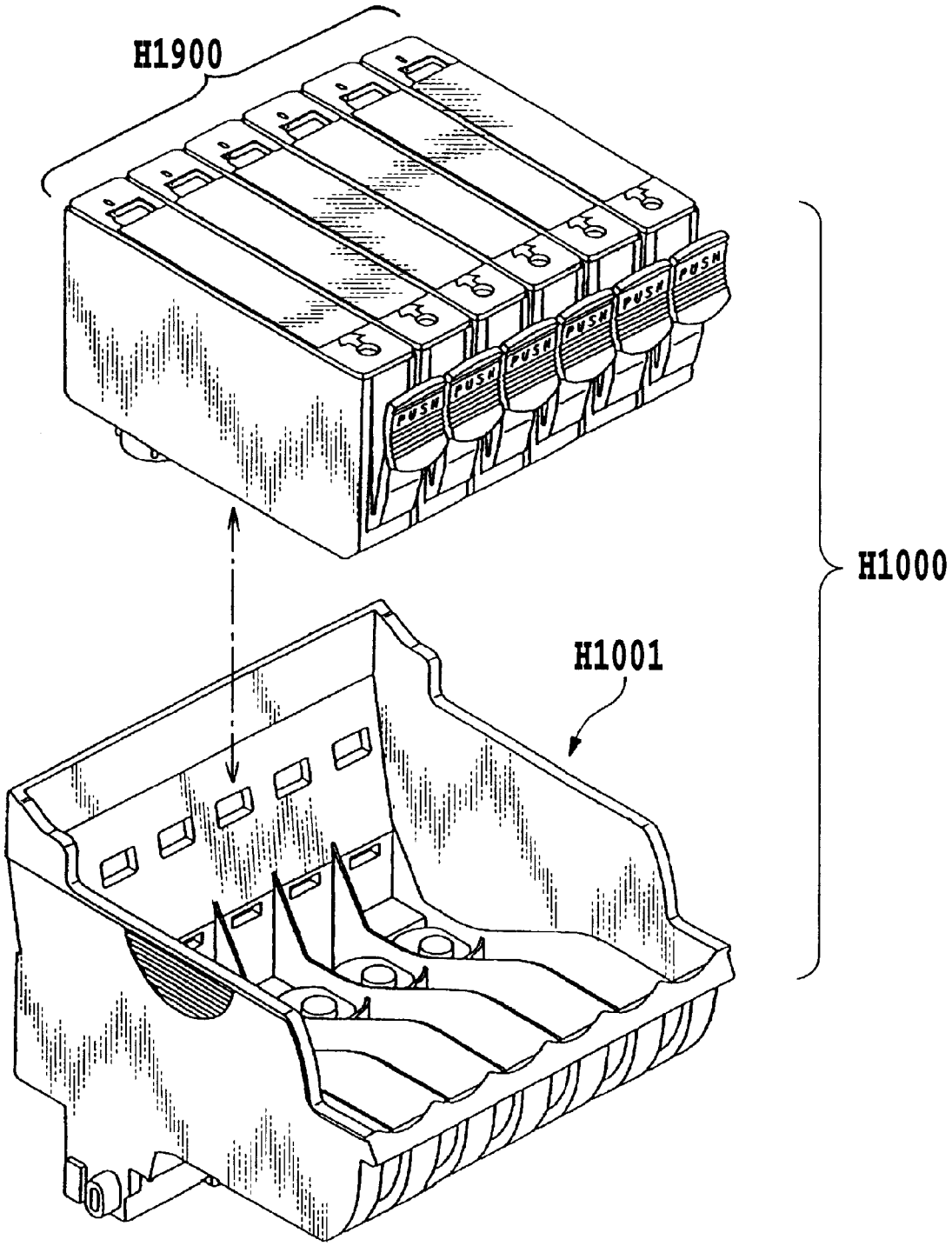
FIG. 4 is an exploded perspective view showing the print head cartridge of FIG. 3.

The print head cartridge H1000 in this embodiment, as shown in FIG. 3, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Figure 5:
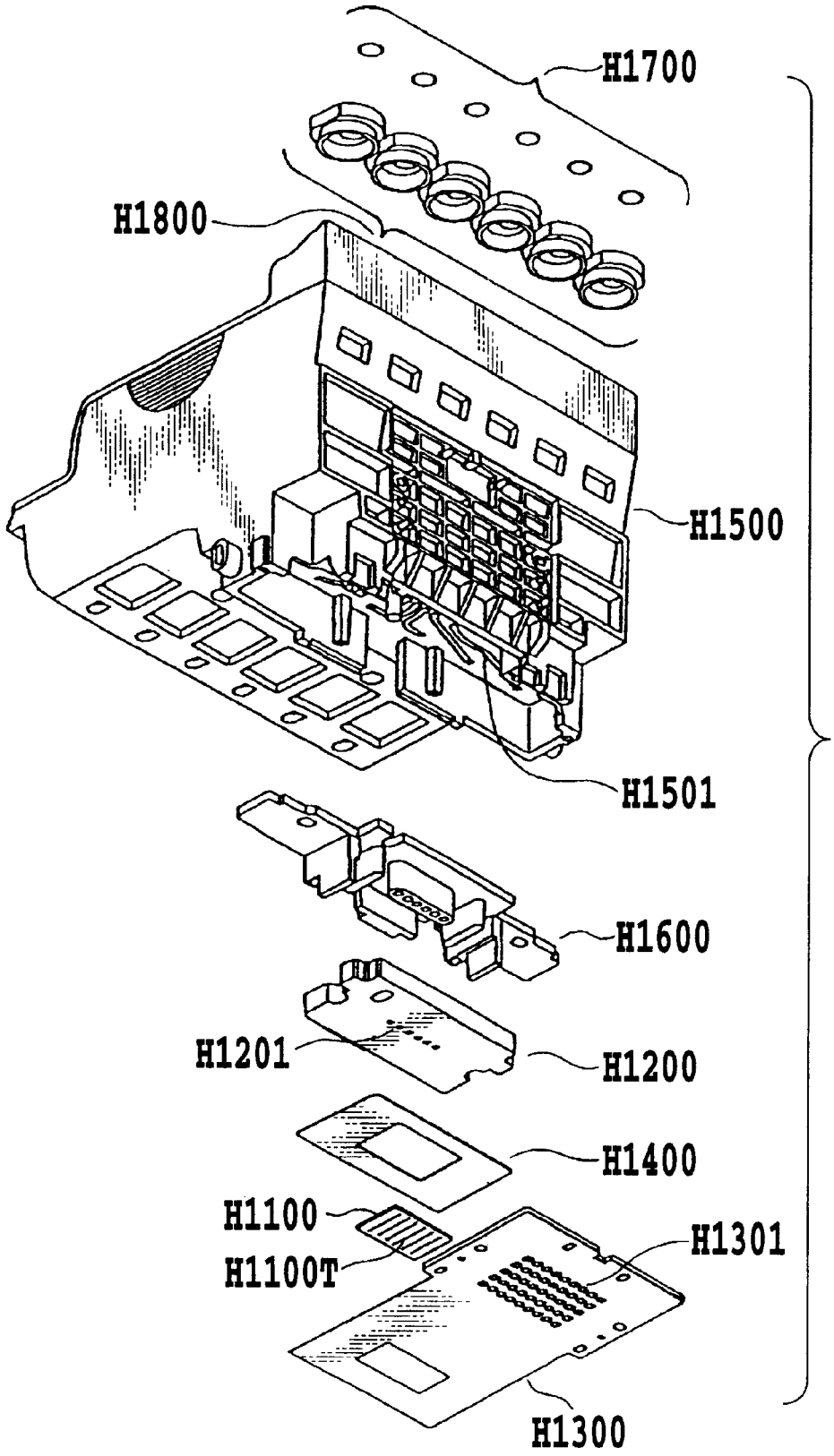
FIG. 5 is an exploded perspective view of the print head of FIG. 4 as seen diagonally below.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely joined to the first plate H1200 which is formed with ink supply ports H1201 for supplying ink to the print element substrate H1100. The first plate H1200 is securely joined with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

2.2. Carriage

Next, by referring to FIG. 2, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (see FIG. 7: simply referred to as a contact FPC hereinafter) E0011 whose contact portion electrically contacts a contact portion (external signal input terminals) H1301 provided in the print head H1001 to transfer various information for printing and supply electricity to the print head H1001.

Between the contract portion of the contact FPC E0011 and the carriage M4001 there is an elastic member not shown, such as rubber. The elastic force of the elastic member and the pressing force of the head set lever spring combine to ensure a reliable contact between the contact portion of the contact FPC E0011 and the carriage M4001. Further, the contact FPC E0011 is connected to a carriage substrate E0013 mounted at the back of the carriage M4001 (see FIG. 7).

3. Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the subscan direction enables one page of document image information to be read.

Figure 6B:
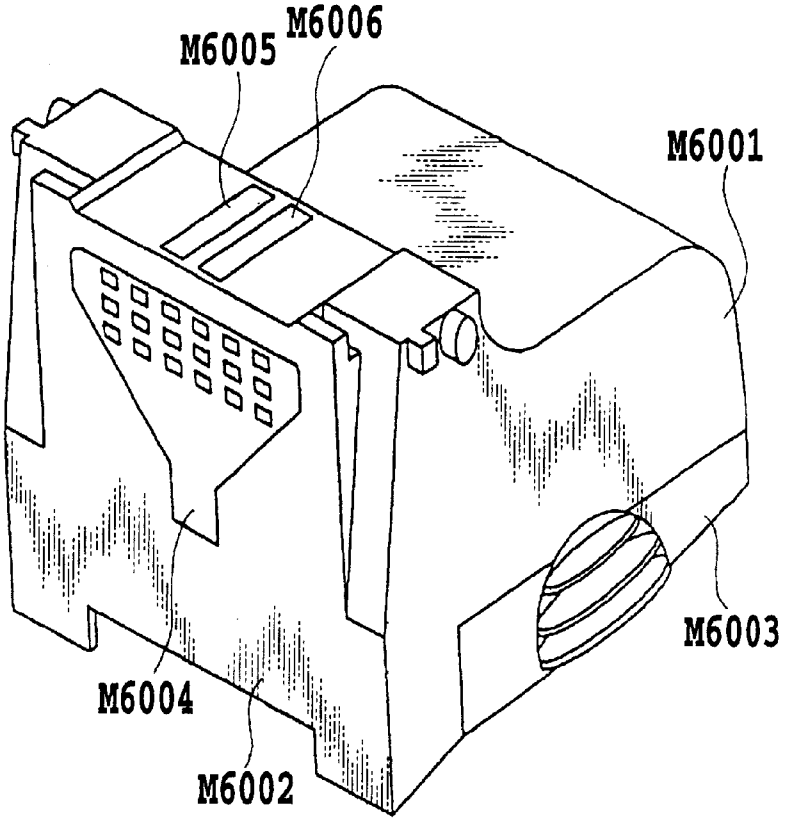
FIGS. 6A and 6B are perspective views showing a construction of a scanner cartridge upside down which can be mounted in the printer of one embodiment of the present invention instead of the print head cartridge of FIG. 3.
Figure 6A:
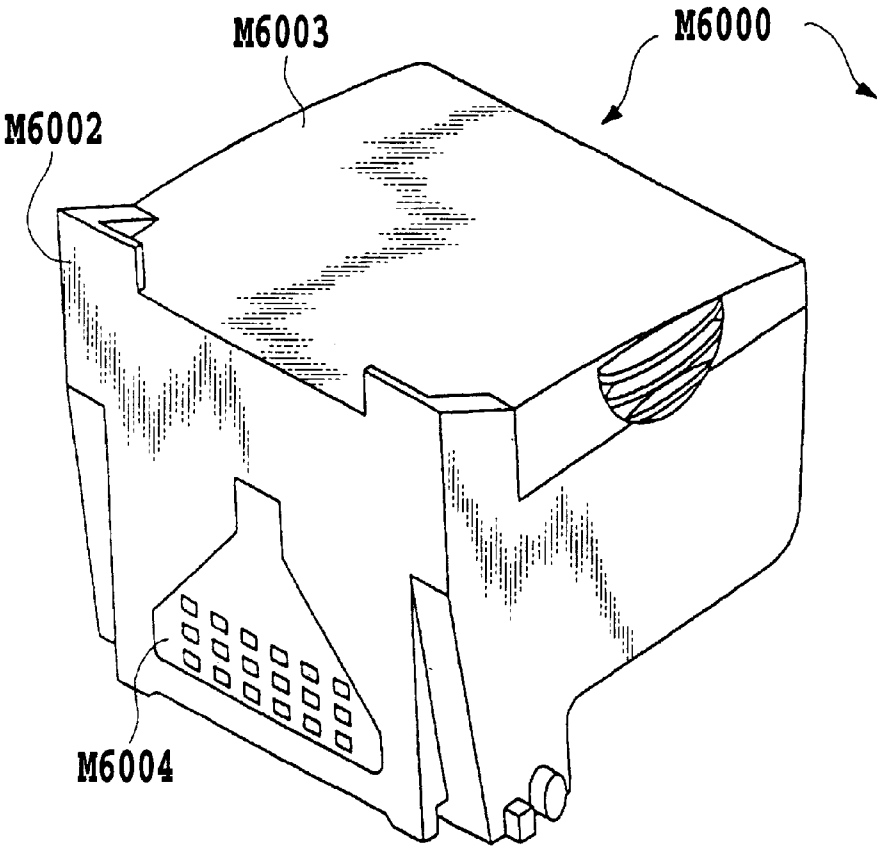

FIGS. 6A and 6B show the scanner M6000 upside down to explain about its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

4. Example Configuration of Printer Electric Circuit

Next, an electric circuit configuration in this embodiment of the invention will be explained.

Figure 7:
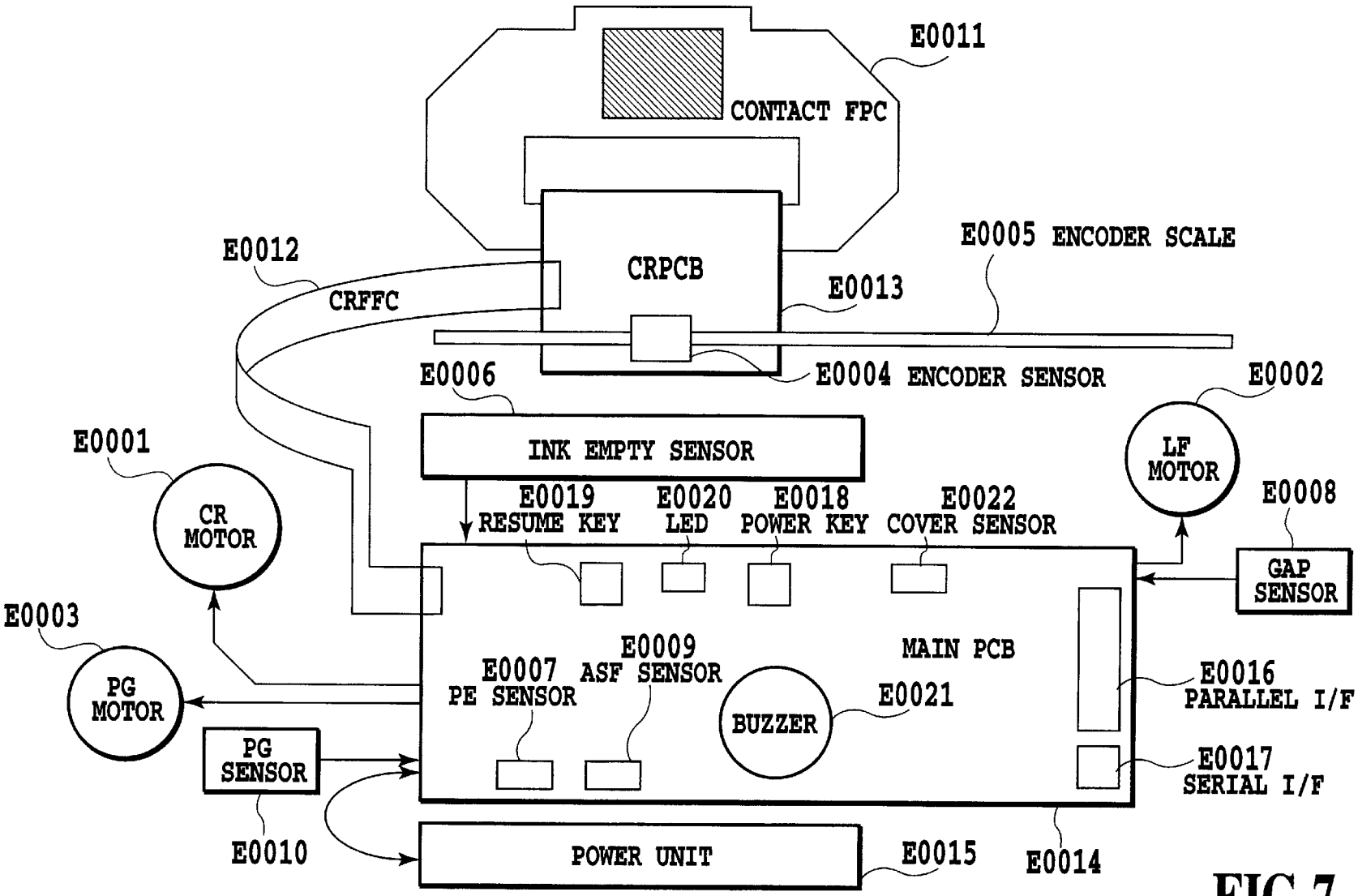
FIG. 7 is a block diagram schematically showing the overall configuration of an electric circuitry of the printer according to one embodiment of the present invention.

FIG. 7 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 8, 8A:
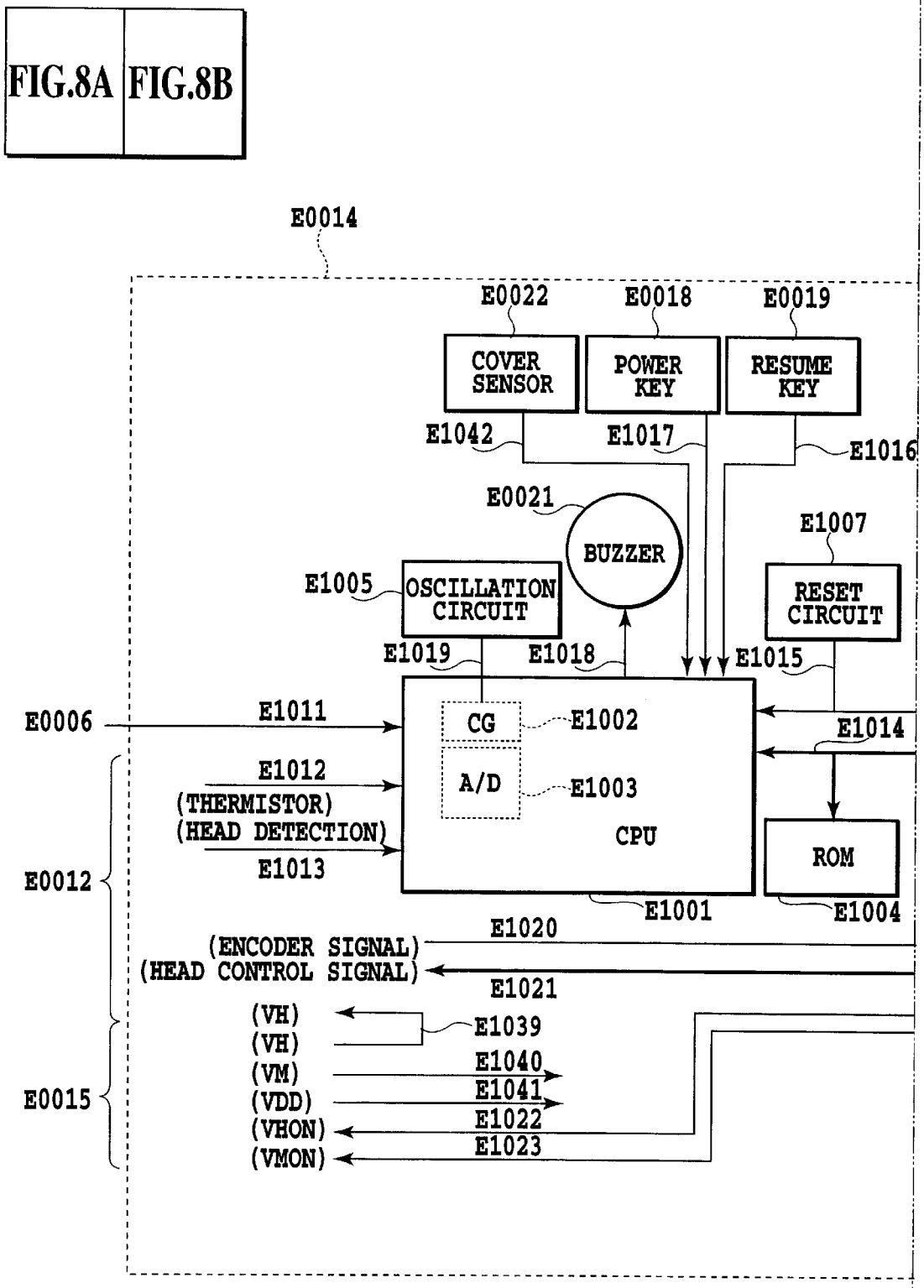
FIG. 8 is a diagram showing the relation between FIGS. 8A and 8B, FIGS. 8A and 8B being block diagrams representing an example inner configuration of a main printed circuit board (PCB) in the electric circuitry of FIG. 7.
Figure 8B:
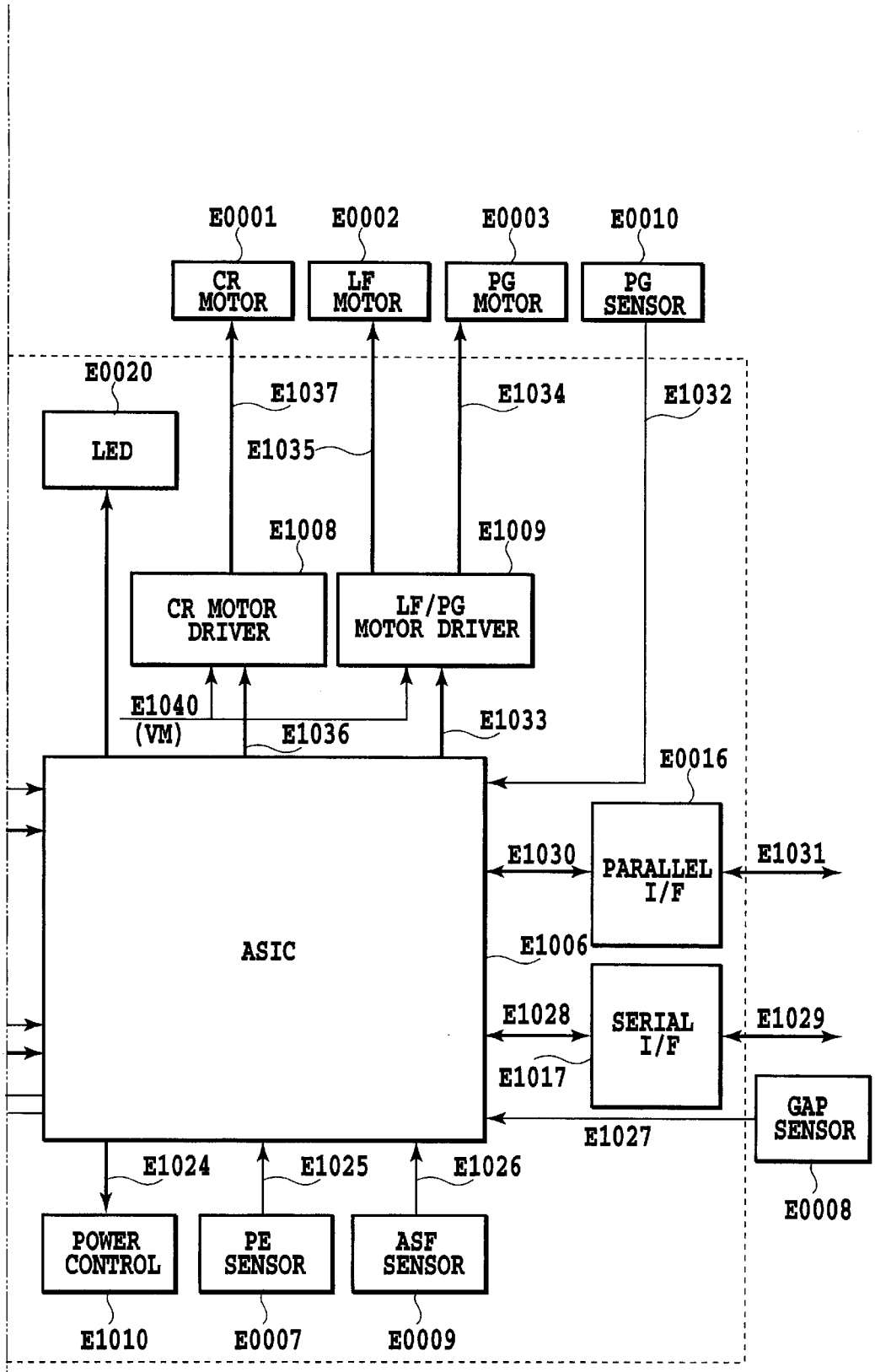

FIG. 8 is a diagram showing the relation between FIGS. 8A and 8B, and FIGS. 8A and 8B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by the main PCB E0014 and then sent out to the flexible flat cable E0011 to be used for driving the print head cartridge H1000. E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PE sensor E0007, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 9, 9A:
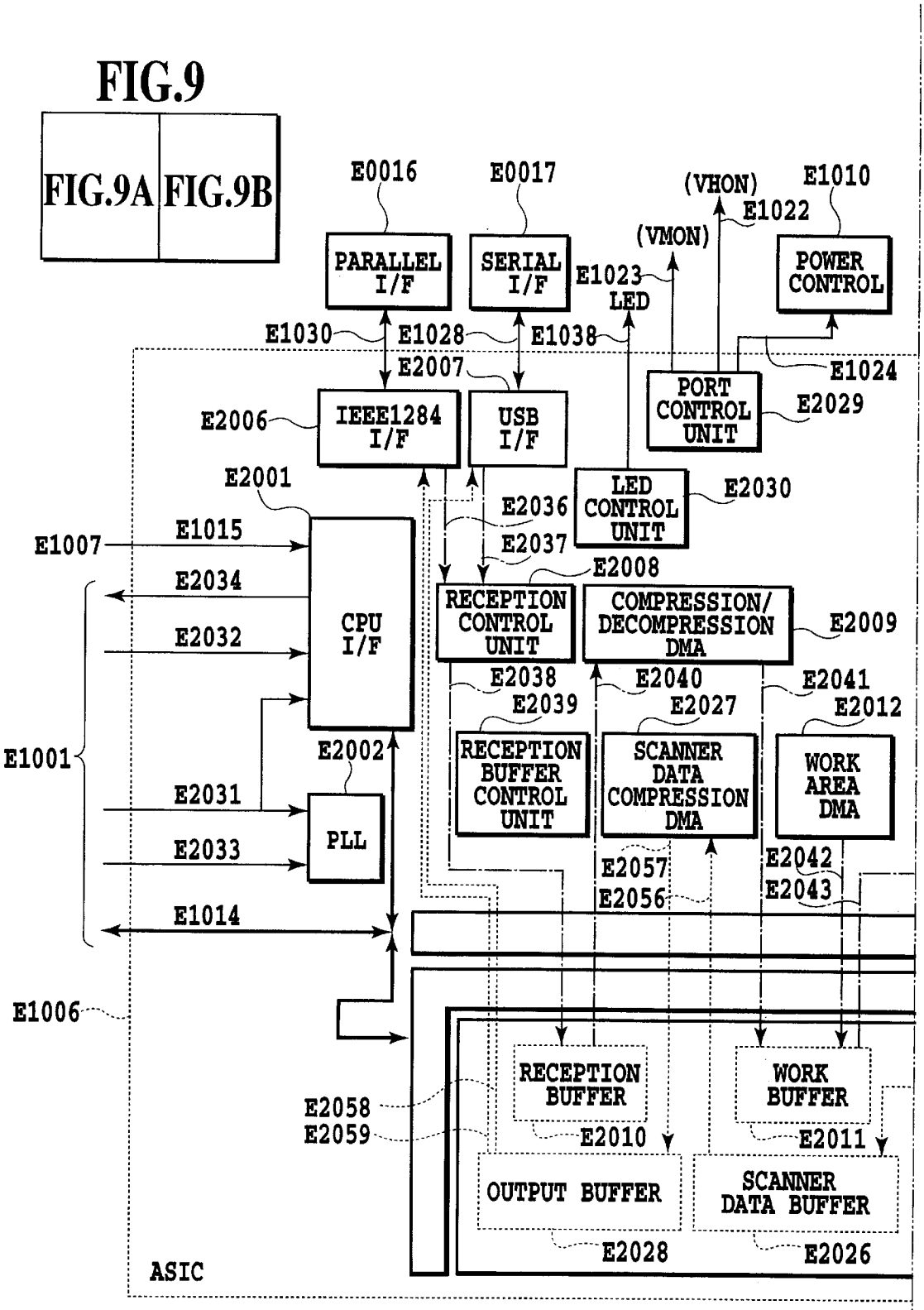
FIG. 9 is a diagram showing the relation between FIGS. 9A and 9B, FIGS. 9A and 9B being block diagrams representing an example inner configuration of an application specific integrated circuit (ASIC) in the main PCB of FIGS. 8A and 8B.
Figure 9B:
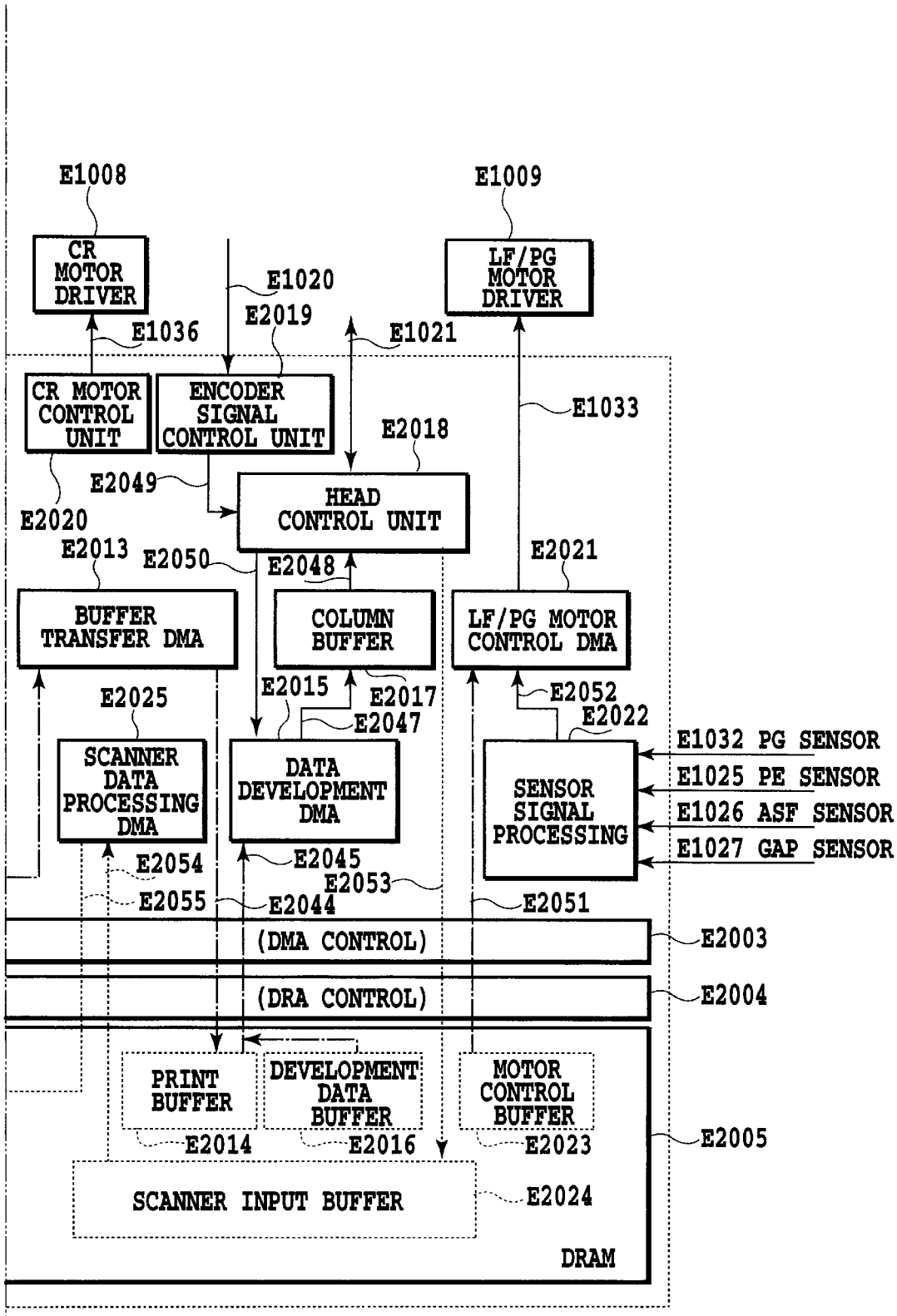

FIG. 9 is a diagram showing the relation between FIGS. 9A and 9B, and FIGS. 9A and 9B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is a IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284

I/F E2006 or universal serial bus (USB) I/F E2007, whichever is selected, into a reception buffer write address managed by a reception buffer control unit E2039.

Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

5. Operation of Printer

Figure 10:
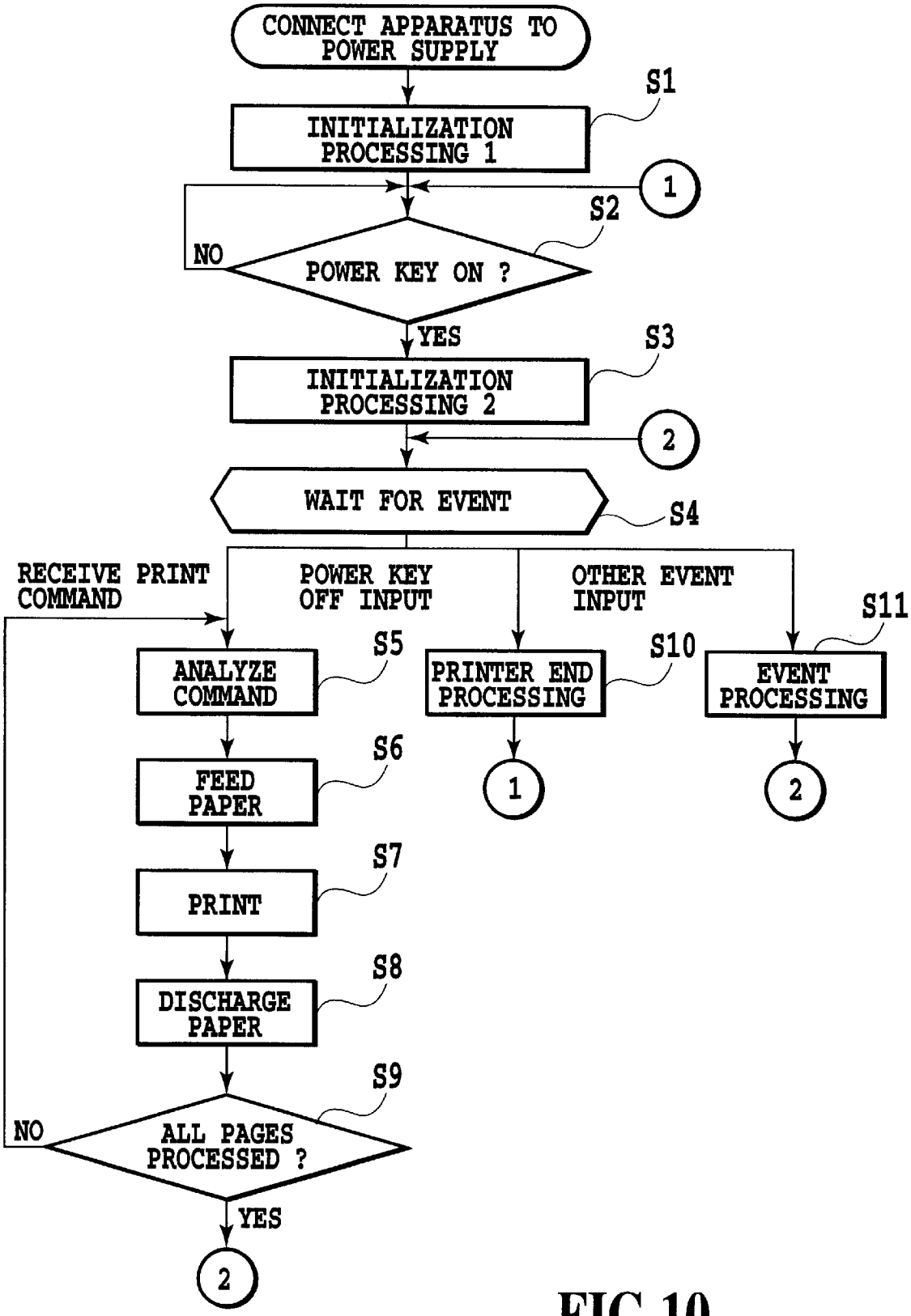
FIG. 10 is a flow chart showing an example of operation of the printer as one embodiment of the present invention.

Next, the operation of the ink jet printing apparatus in this embodiment of the invention with the above configuration will be explained by referring to the flow chart of FIG. 10.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004*a*.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

A form of application where the present invention can effectively be implemented is the ink jet print head in which thermal energy generated by an electrothermal transducer is used to cause film boiling in a liquid to form a bubble.

(First Embodiment)

Some embodiments of the structure of the electrode pad in the print head substrate used in the ink jet printer described above will be explained in the following.

Figure 11:
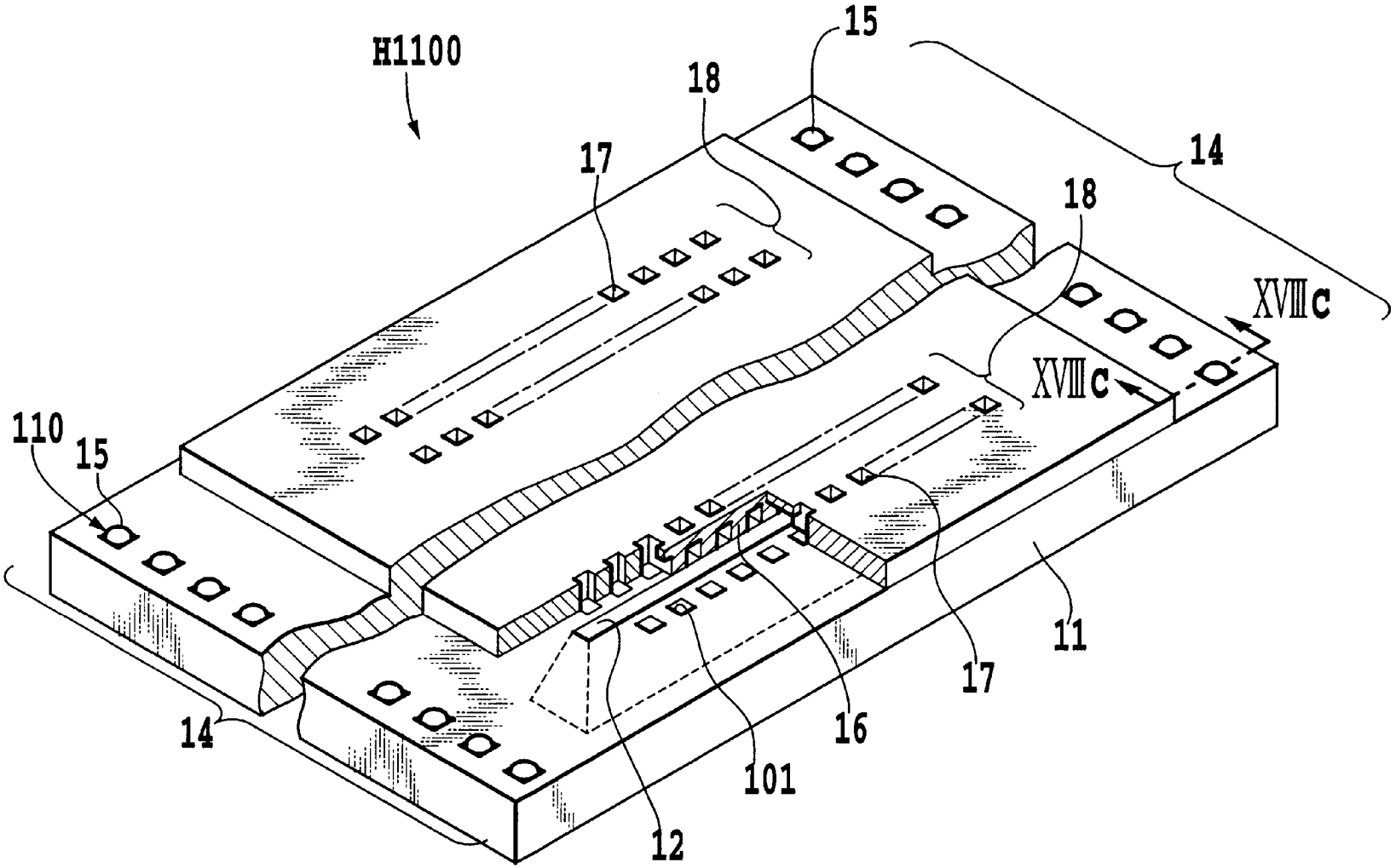
FIG. 11 is a perspective view showing a detailed construction of a print element substrate shown in FIG. 5.

FIG. 11 is a perspective view showing a detailed structure, partly cut away, of the print element substrate (the head chip) H1100 explained in FIG. 5. Although a total of six kinds of ink are ejected from the associated columns of ink ejection ports in the head chip H1100, the figure shows only two columns of ink ejection ports, each two columns matching a different kind of ink.

The head chip H1100 is made by forming a variety of films described above on a substrate 11 as a base, which is formed by for example a silicon (Si) of 0.5–1 mm thickness, and then providing a nozzle forming member including ink ejection ports 17 or the like.

To describe in more detail, the base 11 is formed with an ink supply passage 12 shaped like a long groove passing through the base. On both sides of the ink supply passage 12 two columns of heaters 101 are arranged in a zigzag pattern. In addition to these heaters 101, a second electric wire of aluminum (not shown) is formed by the film deposition technology to supply a drive power to the heaters 101. Further, the base is also provided with electrode portions 14 for electric connection with the printer body side to supply an electric power to the heaters and a drive signal to the drive IC. The electrode portions 14 are each formed with a plurality of electrode pads 110, each of which is joined with a ball bump 15 of, for example, gold in a manner described later.

The ink supply passage 12 formed in the substrate is formed by performing anisotropic etching taking advantage of a crystal orientation of the silicon base 11. When the silicon base has crystal orientations of the <100> in a wafer plane and of the <111> in a thickness direction, an alkaline (KOH, TMAH, hydrazine, etc.) anisotropic etching is performed at an angle of about 55 degrees. This can form the ink supply passage 12 passing through the base 11.

The substrate is further provided with a nozzle forming member. More specifically, the nozzle forming member is formed with ink ejection ports 17 at locations corresponding to their associated heaters 101. The ink ejection ports 17 assigned to each kind of ink are arranged in a column 18, with each ejection port line of the column 18 having an ejection port density of 600 dpi, and the two ejection port lines are arranged zigzag pattern to provide an overall density of 1200 dpi. In forming process of the nozzle forming member, ink passage walls 16 defining ink passages corresponding to the associated heaters 101 are formed by the photolithography as with the ink ejection ports.

In the head chip H1100 of the above structure, the ink supplied to each ink passage through the ink supply passage 12 produces a bubble as the heater 101 generates heat in response to the drive signal, and the pressure of this bubble ejects the ink.

Figure 12:
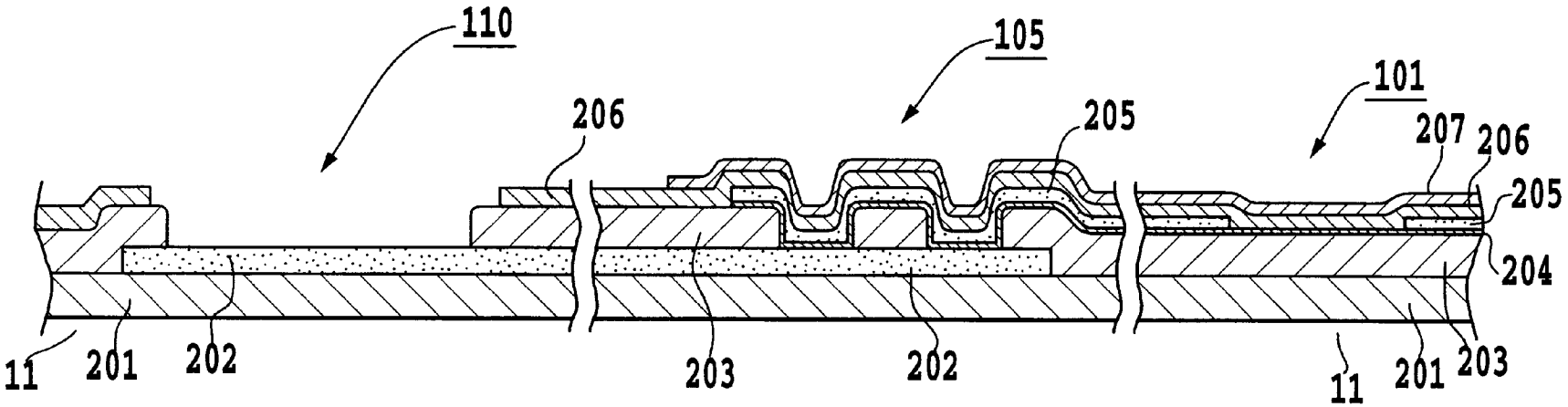
FIG. 12 is a cross section showing a film structure of a print head substrate according to the one embodiment of the invention.
Figure 18:
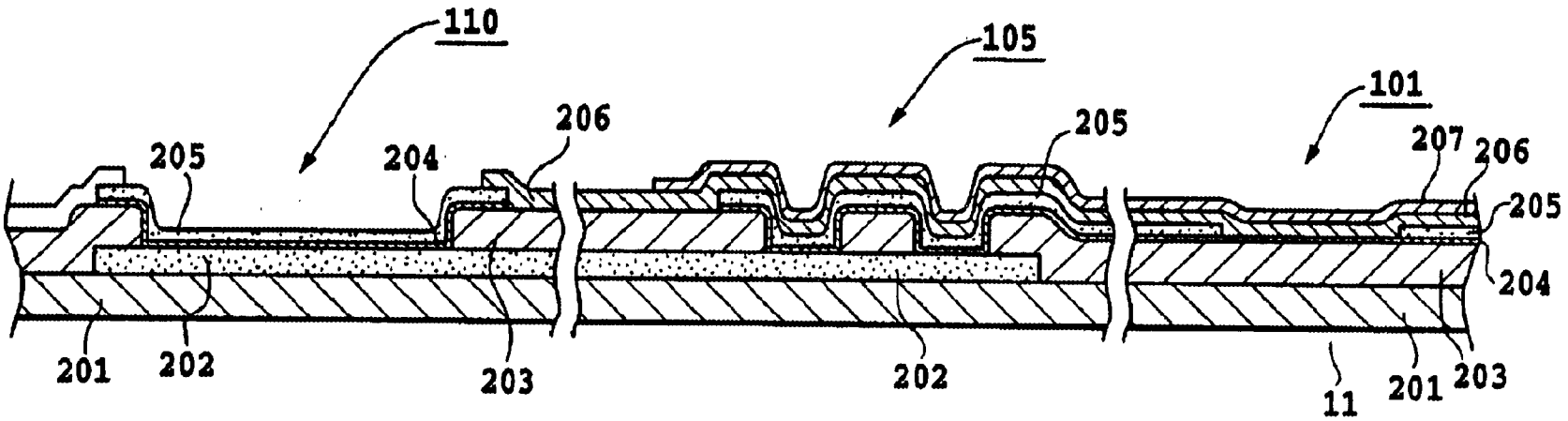
FIG. 18 is a longitudinal cross section showing a film structure of the conventional head substrate.

FIG. 12 is a cross section showing the film structure of the substrate making the head chip H1100 according to the embodiment above and is a similar section to FIG. 18 showing a conventional example.

Figure 13:
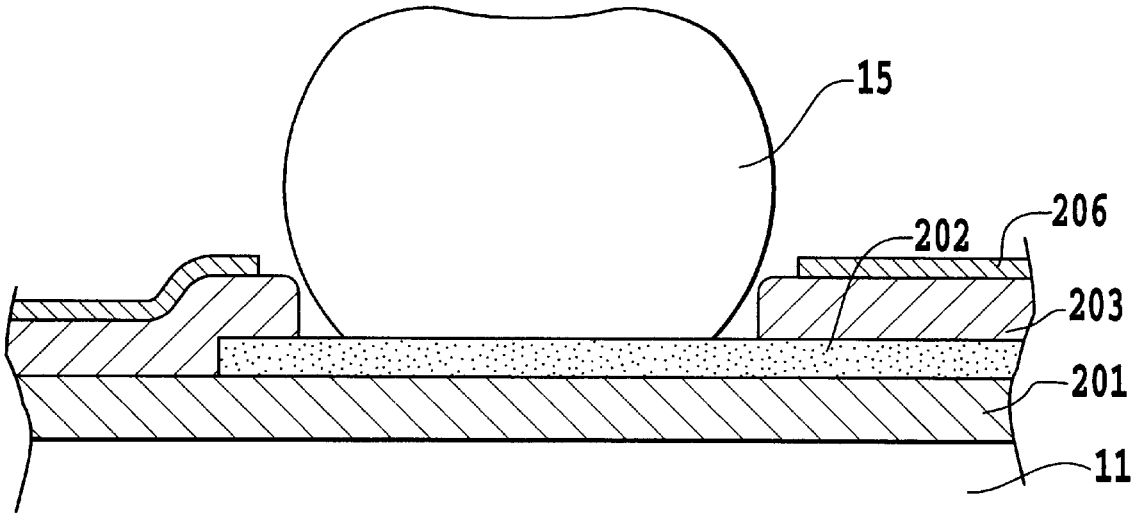
FIG. 13 is a cross section showing a ball bump formed on an electrode pad in the substrate shown in FIG. 12.

What differs from the conventional film structure shown in FIG. 18 is the structure of the electrode pads 110. That is, in this embodiment a surface conductive film to be joined with the ball electrodes is selected to be the first electric wire film 202, which represents the electric wire formed at lower position in the substrate. FIG. 13 shows the first electric wire film 202 joined with the ball bump 15.

The first electric wire film 202 joined with the ball bump 15 forms a common electrode of the matrix wires, as described earlier, and inherently has a relatively large thickness. That is, this wire functions as the common electrode for supplying an electric power or for grounding and has a relatively large film thickness of more than 4,000 Å or preferably about 10,000 Å and a large width pattern to reduce the voltage drop. Even when the protective film is made thin for efficient heat transfer to the ink as described above, because the first electric wire film 202 is under the heater film 204, there is no need to reduce the thickness of the first electric wire film 202 to secure the satisfactory step coverage. This allows the surface conductive film to have an enough thickness to join the ball bump by ultrasonic bonding, thereby assuring a satisfactory joining.

In this embodiment, the gold ball bump is bonded to the electrode pads 110 by a method applying the wire bonding. Then, the ball bump is loaded to flatten their top portions to facilitate the TAB bonding.

A study conducted by the inventor of the present invention has found that the loss of bump occurs when the first electric wire film made of aluminum or aluminum alloy that forms the surface layer of the electrode pad is 4,000 Å or less in thickness. For example, when the thickness of the surface layer of the pad is set at 2,000 Å equal to the thickness of the second electric wire film which was reduced as part of the process of reducing the thickness of the protective film of the heater portion 101, the bump loss occurs with a probability of about 1% to 50%. Even 1% of bump loss necessitates the inspection of the entire head chips, causing a significant burden to the production process. On the other hand, the use of the film structure of the electrode pad according to this embodiment enables satisfactory bonding and forming of the ball bump with almost no cost increase.

Figure 14:
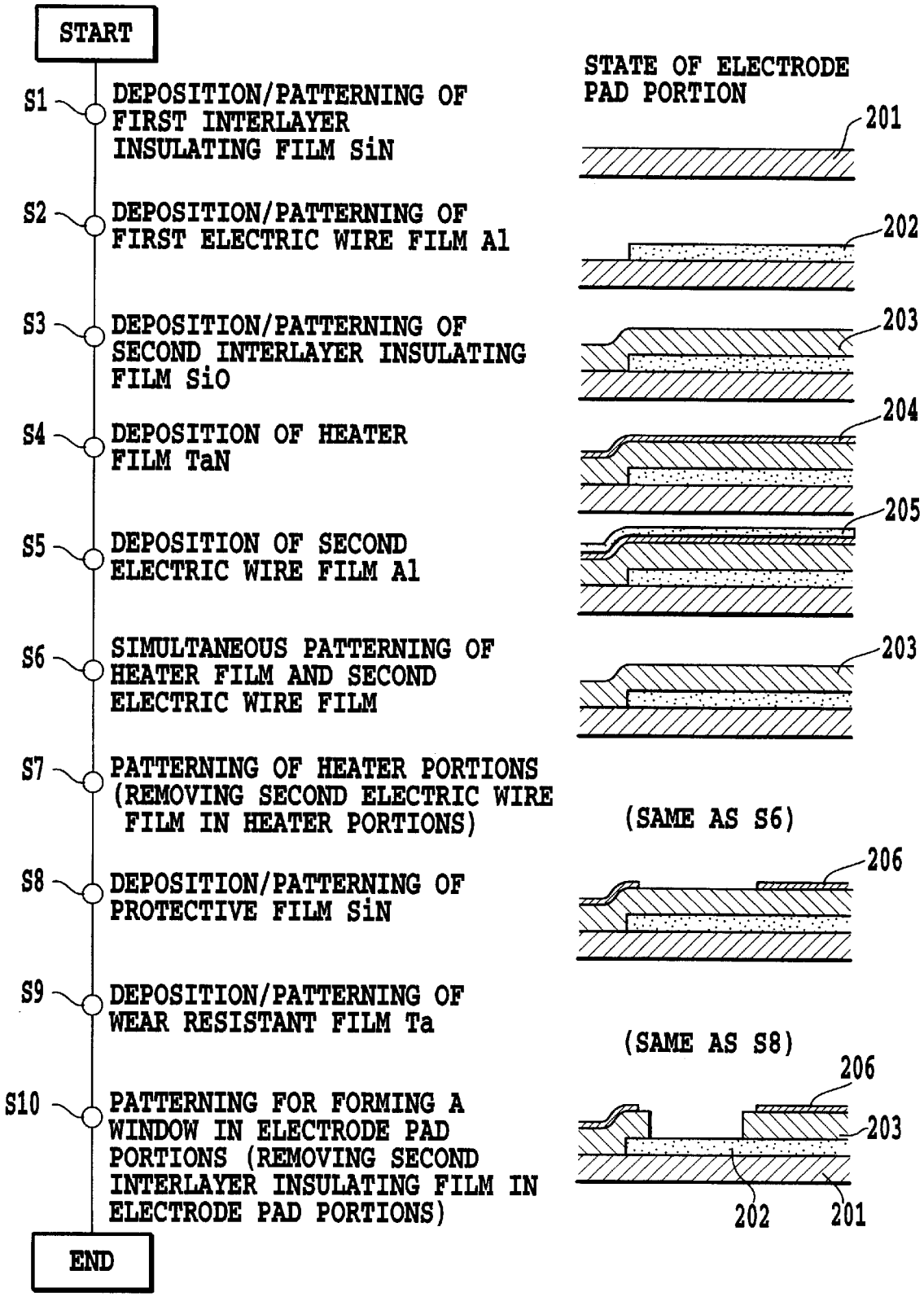
FIG. 14 is an explanatory diagram showing an example method of manufacturing the substrate shown in FIG. 12.

FIG. 14 shows a process of manufacturing the print head according to this embodiment in which the surface layer of the electrode pad 110 is formed by the first electric wire film 202. In the figure, the state of the films of the electrode pad portion at each step is schematically shown to the right. It should also be appreciated that the film structure in the entire area of the substrate including the heater portions and through-hole portions is formed simultaneously by some of the following steps.

In step S1, a SiN film (first interlayer insulating film 201) is deposited to a thickness of 14,000 Å, applied with a resist and exposed by a chemical vapor deposition (CVD) device and then patterned by a dry etching device. Next at step S2, an aluminum or aluminum alloy film (first electric wire film 202) is deposited to a thickness of 10,000 Å, applied with a resist and exposed by a sputtering device and then patterned by a dry etching device. At step S3, a SiO film (second interlayer insulating film 203) is deposited to 14,000 Å, applied with a resist and exposed by the CVD device and patterned by a wet etching device. Further at step S4, a TaN film (heater film 204) is deposited to 400 Å by the sputtering device. Then at step S5, an aluminum film (second electric wire film 205) is deposited to a thickness of 2,000 Å by the sputtering device. The process up to this point is performed in the same way as in the heater portion.

At the next step S6, an aluminum film (second electric wire film 205) of 2,000 Å thick and a TaN film (heater film 204) of 400 Å thick are applied with a resist and exposed and then simultaneously patterned by a dry etching device. This simultaneous patterning removes the second electric wire film 205 and the heater film 204 from the electrode pads 110. In this embodiment, the use of the simultaneous patterning minimizes a possible increase in the number of steps which may otherwise result when the lower of the two electric wire films, or the first electric wire film 202, is used as the surface conductive film.

Step S7 patterns and forms the heater portions 101 by applying a resist to and exposing the aluminum film (second electric wire film 205) of 2,000 Å thick and then removing the aluminum film with a wet etching device. At this time, the electrode pad portions 110 remain as formed by the step S6.

Next step S8 deposits a SiN film (protective film 206) to a thickness of 3,000 Å, applies a resist to and exposes the film by the CVD device and patterns the film by a dry etching device.

Next, at step S9, a Ta film (wear resistant film 207) is deposited to a thickness of 2,300 Å, applied with a resist and exposed at other than the electrode pad portions, and then patterned by a dry etching device. At this time, the electrode pad portion 110 remain as formed by the step S8.

Then, at final step S10, a SiO film (second interlayer insulating film 203) is removed to a thickness of 14,000 Å, by being applied with a resist and exposed and by a dry etching device to form the electrode pad.

(Second Embodiment)

The electrode pad structure according to the second embodiment of the invention will be described according to the film making process.

Figure 15:
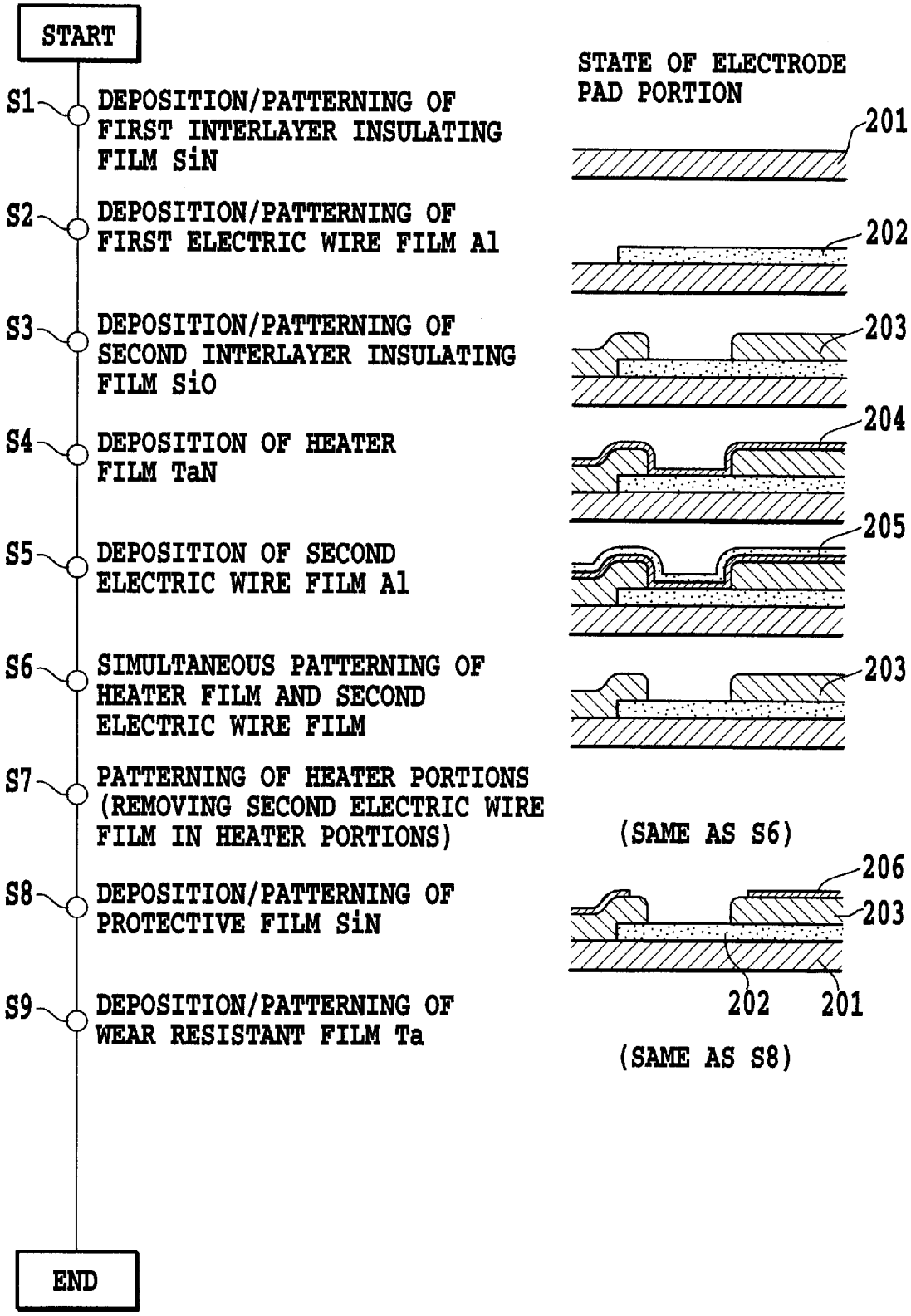
FIG. 15 is an explanatory diagram showing another example method of manufacturing the substrate shown in FIG. 12.
Figure 16:
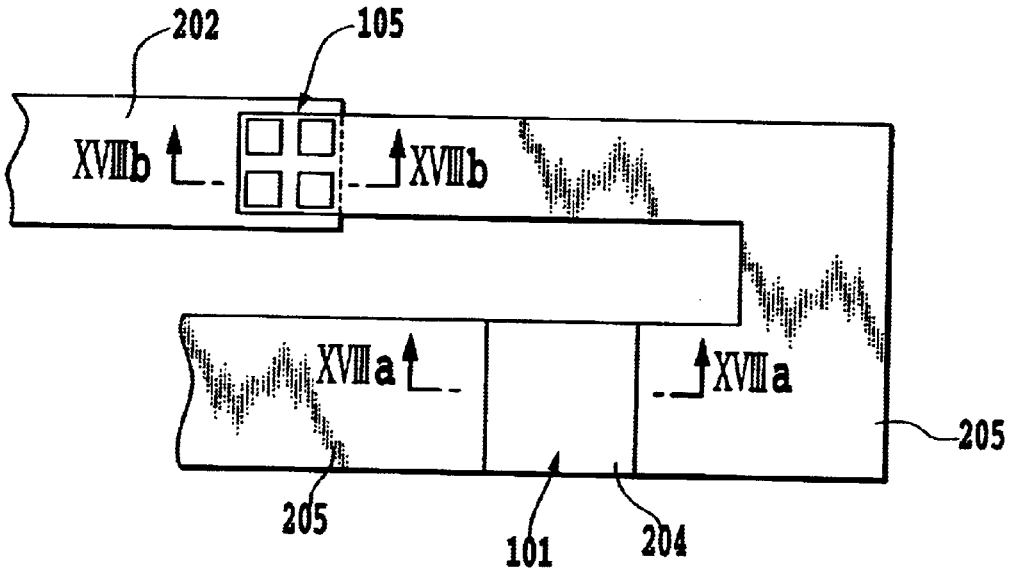
FIG. 16 is a plan view showing in particular an example of an electric wire in a conventional print head substrate.
Figure 17:
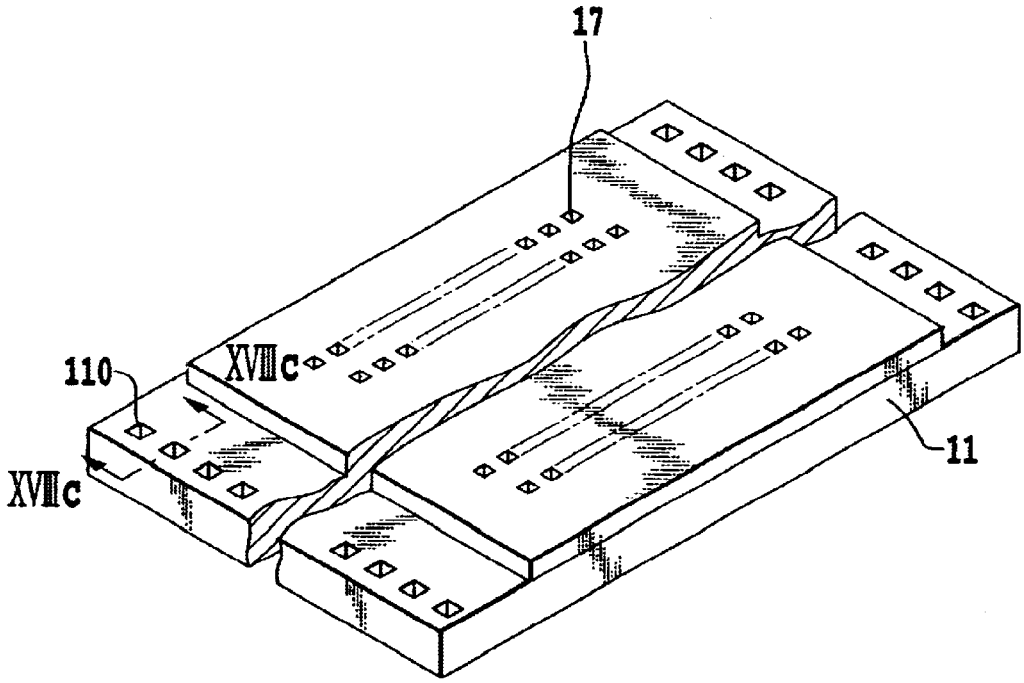
FIG. 17 is a perspective view showing a head chip using the conventional substrate.

FIG. 15 shows the process of manufacturing the print head according to the second embodiment. What differs from the manufacturing process according to the first embodiment shown in FIG. 14 is that at step S3 the SiO film (second interlayer insulating film 203) in the electrode pad portions 110 is formed with a window of 14,000 Å deep. Another differing point is that the TaN (heater film 204) and the second electric wire film 205 formed over the second interlayer insulating film 203 are removed by step S5.

This eliminates the need of step S10 shown in FIG. 14. However, the first electric wire film 202 in the electrode pad portion is etched away to some extent by the etching at step S3 and the subsequent steps. Thus the first electric wire film 202 must be made thicker than shown in the step of FIG. 14. The amount by which the first electric wire film 202 is made thicker, of course, varies depending on the amount of overetch caused by the etching step.

As can be seen from the foregoing, according to the embodiments of this invention, because the exposed part of the first wire electrode underlying the heater forms the electrode pad, a film which does not need to be reduced in thickness to secure the heater protective film's step coverage even when the protective film is made thinner can be used for the electrode pad. Further, an inherently thick film can be used for the electrode pad. As a result, when the ball bump is joined by an ultrasonic bonding process bonding, the bonding strength can be increased.

As a result, the bonding of ball bump can be stabilized, preventing the ball bump from getting disconnected. This eliminates the head chip inspection step and therefore reduces the number of inspection workers, lowering the cost. Further, in a thin film structure that can meet the conditions for further energy consumption reductions required of the ink jet print head, this invention can stably bond the ball bumps.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A substrate for an ink jet print head that uses thermal energy to eject ink, said substrate comprising:

a film structure having a plurality of films laminated on said substrate, the plurality of films including a first electric wire film, a heater film and a second electric wire film formed one upon the other in that order on said substrate, a combination of the heater film and the second electric wire film allowing the thermal energy to be generated on a portion where the second electric wire film is not laminated on the heater film;

wherein an electrode pad portion, which is formed at a part of said film structure to make an electrical connection to a power source through a ball bump, is formed by an exposed part of the first electric wire film, the ball bump being formed on the exposed part of the first electric wire film, and a thickness of the first electric wire film is larger than that of the second electric wire film.

2. The substrate as claimed in claim 1, wherein said film structure has a protective film over the heater film and the second electric wire film.

3. The substrate as claimed in claim 2, wherein the first electric wire film is made from aluminum or aluminum alloy and has a thickness of 4,000 Å or more.

4. An ink jet print head which uses thermal energy to eject ink, comprising:

a substrate making said ink jet print head, said substrate including:

a film structure having a plurality of films laminated on said substrate, the plurality of films including a first electric wire film, a heater film and a second electric wire film formed one upon the other in that order on said substrate, a combination of the heater film and the second electric wire film allowing the thermal energy to be generated on a portion where the second electric wire film is not laminated on the heater film;

wherein an electrode pad portion, which is formed at a part of said film structure to make an electrical connection to a power source through a ball bump, is formed by an exposed part of the first electric wire film, the ball bump being formed on the exposed part of the first electric wire film, and a thickness of the first electric wire film is larger than that of the second electric wire film.

5. The ink jet print head as claimed in claim 4, wherein said film structure has a protective film over the heater film and the second electric wire film.

6. The ink jet print head as claimed in claim 5, wherein the first electric wire film is made from aluminum or aluminum alloy and has a thickness of 4,000 Å or more.

* * * * *